US012405074B2

(12) United States Patent
Hell et al.

(10) Patent No.: US 12,405,074 B2
(45) Date of Patent: Sep. 2, 2025

(54) LOCKING DEVICE FOR INSTALLING A HANDLE ASSEMBLY OF A HANDGUN

(71) Applicant: Glock Technology GmbH, Ferlach (AT)

(72) Inventors: Sebastian Hell, Weikendorf (AT); Josef Kroyer, Zemendorf (AT)

(73) Assignee: Glock Technology GmbH (AT)

( * ) Notice: Subject to any disclaimer, the term of this patent is extended or adjusted under 35 U.S.C. 154(b) by 0 days.

(21) Appl. No.: 18/723,112

(22) PCT Filed: Dec. 23, 2022

(86) PCT No.: PCT/AT2022/060462

§ 371 (c)(1),
(2) Date: Jun. 21, 2024

(87) PCT Pub. No.: WO2023/115093

PCT Pub. Date: Jun. 29, 2023

(65) Prior Publication Data

US 2025/0123065 A1 Apr. 17, 2025

(30) Foreign Application Priority Data

Dec. 23, 2021 (EP) ..... 21217340

(51) Int. Cl.
*F41A 3/66* (2006.01)
*F41C 3/00* (2006.01)

(52) U.S. Cl.
CPC . *F41A 3/66* (2013.01); *F41C 3/00* (2013.01)

(58) Field of Classification Search
CPC ..... F41A 11/00; F41A 3/66; F41C 3/00
See application file for complete search history.

(56) References Cited

U.S. PATENT DOCUMENTS 3,745,881 A * 7/1973 Roy ..... F41A 3/64 89/196
5,649,383 A * 7/1997 Wesp ..... F41A 21/484 42/63

(Continued)

FOREIGN PATENT DOCUMENTS

AT A125783 A 8/1992
EP 3205971 A1 8/2017

(Continued)

OTHER PUBLICATIONS

Breech-Block System for a Firearm translation (Year: 2019).*
English abstract for A125783.

*Primary Examiner* — Reginald S Tillman, Jr.
(74) *Attorney, Agent, or Firm* — Fishman Stewart PLLC

(57) ABSTRACT

A locking device for installation in a receiver assembly of a firearm. Unlocking the locking device allows removal of the slide assembly from the receiver assembly. The locking device includes a locking slider having a retaining lug, first and second guide members each formed on the locking slider, and a locking lever. The retaining lug may interact with a barrel to limit a movement of the slide assembly relative to the receiver assembly. The first and second guide members are received in first and second receiving slots, respectively, of a grip/receiver. The locking lever is pivotable about a pivoting axis and is couplable to the locking slider in such a way that the locking lever serves to actuate the locking slider. A transfer of the locking slider from a retaining position to a release position is effected by rotation of the locking lever.

20 Claims, 6 Drawing Sheets

(56) References Cited

U.S. PATENT DOCUMENTS

| | | | | |
|---|---|---|---|---|
| 7,392,611 | B2 * | 7/2008 | Curry | F41A 11/00 42/108 |
| 9,568,262 | B2 * | 2/2017 | Bantle | F41A 17/34 |
| 9,891,014 | B2 * | 2/2018 | Dechant | F41A 21/488 |
| 11,029,105 | B2 | 6/2021 | Tai | |
| 2012/0192474 | A1 | 8/2012 | Pratt | |
| 2013/0031313 | A1 | 1/2013 | Ryan | |
| 2013/0081318 | A1 | 4/2013 | Morando | |
| 2017/0321977 | A1 | 11/2017 | Teitel | |

FOREIGN PATENT DOCUMENTS

| | | | | |
|---|---|---|---|---|
| PL | 227014 | B1 | 10/2017 | |
| WO | WO-2019029851 | A1 * | 2/2019 | F41A 3/44 |

* cited by examiner

LOCKING DEVICE FOR INSTALLING A HANDLE ASSEMBLY OF A HANDGUN

CROSS REFERENCE TO RELATED APPLICATIONS

This application is a US National Phase application of PCT/AT2022/060462, filed on Dec. 23, 2022, which claims priority to EP-21217340.5, filed Dec. 23, 2021. The contents of both of these applications are incorporated by reference in their entirety.

TECHNICAL FIELD

The invention relates to a locking device for installation in a receiver assembly of a firearm, a receiver assembly equipped therewith, and a firearm equipped with the receiver assembly.

BACKGROUND

The firearm according to the invention can be a pistol.

US 2013/031313 A1 discloses an auxiliary element for gripping a locking slide of a handgun. The locking slide can be actuated by applying an axial pull to the auxiliary element.

Receiver assemblies having locking sliders are known from AT A125783 A and U.S. Pat. No. 11,029,105 B2. The basic mechanism of a locking slider of this type serves to establish the connection between the barrel, which is arranged in a slide assembly, and the receiver assembly of a firearm by means of a locking element. The locking slider limits the forward movement of the barrel, and thus the slide assembly of a firearm, during the forward movement of the slide assembly during the closing motion. The receiver assembly comprises a grip/receiver and a locking slider received in the grip/receiver. A first guide member, which is received in a first receiving slot of the grip/receiver, is formed on the locking slider. Furthermore, a second guide member, which is received in a second receiving slot of the grip/receiver, is formed on the locking slider. The locking slider can be gripped in the region of the first guide member and the second guide member and moved between a retaining position and a release position. Furthermore, the locking slider is biased into the retaining position by means of a locking spring.

In rare circumstances, it can be somewhat difficult to actuate known locking sliders, especially for users with minimal finger strength. It can also be difficult to actuate the locking slider while wearing gloves.

Another similar locking slider, which disengages a retaining part from the barrel of a firearm by laterally moving an actuating element, is known from EP 3205971 B1.

SUMMARY

The aim of the present invention was to overcome the disadvantages of the prior art and to provide an alternative locking device for installation in a receiver assembly of a firearm, a receiver assembly equipped therewith, and a firearm equipped with the receiver assembly, which allow simplified handling.

This aim is achieved by a locking device for installation in a receiver assembly of a firearm, a receiver assembly equipped therewith, and a firearm equipped with the receiver assembly according to the claims.

A locking device for installation in a receiver assembly of a firearm is provided according to the invention. The locking device serves for limiting a movement of a slide assembly relative to the receiver assembly, wherein unlocking of the locking device allows removal of the slide assembly from the receiver assembly. The locking device comprises:

- a locking slider, the locking slider having a retaining lug which is designed to interact with a barrel received in a slide assembly of the firearm in a retaining position for limiting a movement of the slide assembly relative to the receiver assembly, a first guide member, which is designed to be received in a first receiving slot of a grip/receiver of the receiver assembly, being formed on the locking slider, and a second guide member, which is designed to be received in a second receiving slot of the grip/receiver of the receiver assembly, being formed on the locking slider.

The locking device comprises a locking lever, wherein the locking slider is movable between the retaining position and the release position by means of the locking lever.

Further, the locking lever being receivable on the grip/receiver of the receiver assembly so as to be pivotable about a pivoting axis between a basic position and an open position. Further, the locking slider being couplable to the locking lever in such a way that the locking lever serves to actuate the locking slider, wherein a transfer of the locking slider from its retaining position to the release position is effected by rotation of the locking lever.

An advantage of the locking device according to the invention is that a firearm equipped with the locking device is easier to handle. In particular, unlocking the locking device and thus removing the slide assembly from the receiver assembly can be facilitated by the measures according to the invention. In addition, a locking device designed in this way can have a robust structure, as a result of which the durability of the firearm can be improved.

Furthermore, it can be expedient for the locking slider to comprise an actuating part and a retaining part, with the first guide member and the second guide member being formed on the actuating part and the retaining lug being arranged on the retaining part, the actuating part and the retaining part being designed as structurally independent components which can moved relative to one another. This measure makes it possible for the slide assembly to slide onto the receiver assembly without the locking lever having to be pivoted from its basic position into its open position in the process.

Furthermore, the retaining part can be C-shaped, with the actuating part being receivable between the two legs of the C-shaped retaining part. This measure allows a simple structure of the locking device to be achieved.

In addition, the actuating part can have a greater width than the retaining part, so that the first guide member and the second guide member protrude relative to the actuating part. This measure allows good accommodation of the locking device in the grip/receiver to be achieved.

Also advantageous is an embodiment according to which the actuating part and the retaining part can each be designed as shaped sheet metal parts. An actuating part or retaining part designed in this way can have a simple and robust structure.

According to a development, it is possible for the height of the actuating part to be smaller than an open portion extension of the retaining part. This measure makes it possible for the actuating part to move relative to the retaining part.

A receiver assembly for a firearm is provided according to the invention. The receiver assembly comprises:

a grip/receiver;

a locking device, the locking device being received in a locking device receptacle of the grip/receiver, the locking device comprising a locking slider, the locking slider being movable between a retaining position and a release position, the locking slider having a retaining lug which is designed to interact with a slide assembly of the firearm in the retaining position and to release the slide assembly in the release position, a first guide member, which is received in a first receiving slot of the grip/receiver, being formed on the locking slider and a second guide member, which is received in a second receiving slot of the grip/receiver, being formed on the locking slider.

The locking device comprises a locking lever, the locking lever being received on the grip/receiver of the receiver assembly so as to be pivotable about a pivoting axis, and the locking slider being coupled to the locking lever in such a way that the locking lever serves to move the locking slider from the retaining position to the release position.

The retaining part can also be biased into a retaining position by means of a locking spring. This simplifies the handling of the firearm.

In addition, the locking lever can be received on the grip/receiver so as to be pivotable between a basic position and an open position, with the locking slider being movable between a retaining position and a release position by means of the locking lever. An advantage of the locking device according to the invention is that a firearm equipped with the locking device is easier to handle. In particular, unlocking the locking device and thus removing the slide assembly, including the barrel, from the receiver assembly can be facilitated by the measures according to the invention. In addition, a locking device designed in this way can have a robust structure, as a result of which the durability of the firearm can be improved.

The locking lever can also have a first lever part and a second lever part, a first recess being formed in the first lever part and a second recess being formed in the second lever part, the first guide member being received in the first recess in a form-fitting manner and the second guide member is received in the second recess in a form-fitting manner. This measure allows the locking lever to be attached to the locking slider.

According to one particular embodiment, it is possible for the first guide member to have a guide member height and for the first recess to have a recess height and for a release distance to be formed between the retaining position and the release position, the recess height being at least as great as the guide member height plus the release distance. This measure makes it possible even for a locking slider which is designed in one piece to be moved into its release position when the slide assembly is joined to the receiver assembly without the locking lever having to be pivoted at the same time.

According to an advantageous development, the locking slider can be designed in one piece, with the retaining lug, the first guide member, and the second guide member being formed on one component.

In particular, it can be advantageous for a trigger lever to be received in the grip/receiver so as to be pivotable by means of a trigger axis, the trigger axis being coaxial with the pivoting axis. This has the advantage that the trigger axis can be used to pivotably receive a plurality of components at the same time; therefore, the number of components can be reduced and the firearm can be made less complex.

Furthermore, the first recess can have a first recess width and the first guide member can have a first guide member width, the first recess width being between 105% and 700%, in particular between 150% and 400%, preferably between 200% and 350%, of the first guide member width.

In addition, the locking device can be designed such that the retaining lug of the locking slider can move from the retaining position to the release position counter to the spring force of a locking spring when the slide assembly, including the barrel, is pushed on from the front, without the locking lever having to be pivoted from its basic position to its open position in the process. The advantage of this measure is that the handling of the firearm can be simplified.

A slide within the meaning of this document is also often referred to as a bolt. In addition to the actual slide, the slide assembly also includes components attached thereto, as well as a barrel received therein, which is evident to a person skilled in the art in the context of this application.

The invention is explained in more detail with reference to the following drawings for a better understanding.

BRIEF DESCRIPTION OF THE DRAWINGS

The drawings show, in a greatly simplified and schematic manner.

DETAILED DESCRIPTION

It should first be noted that in the variously described embodiments, the same parts are provided with the same reference signs or the same component names, and all the disclosures in the description can be transferred accordingly to the same parts with the same reference signs or the same component names.

Figure 1:
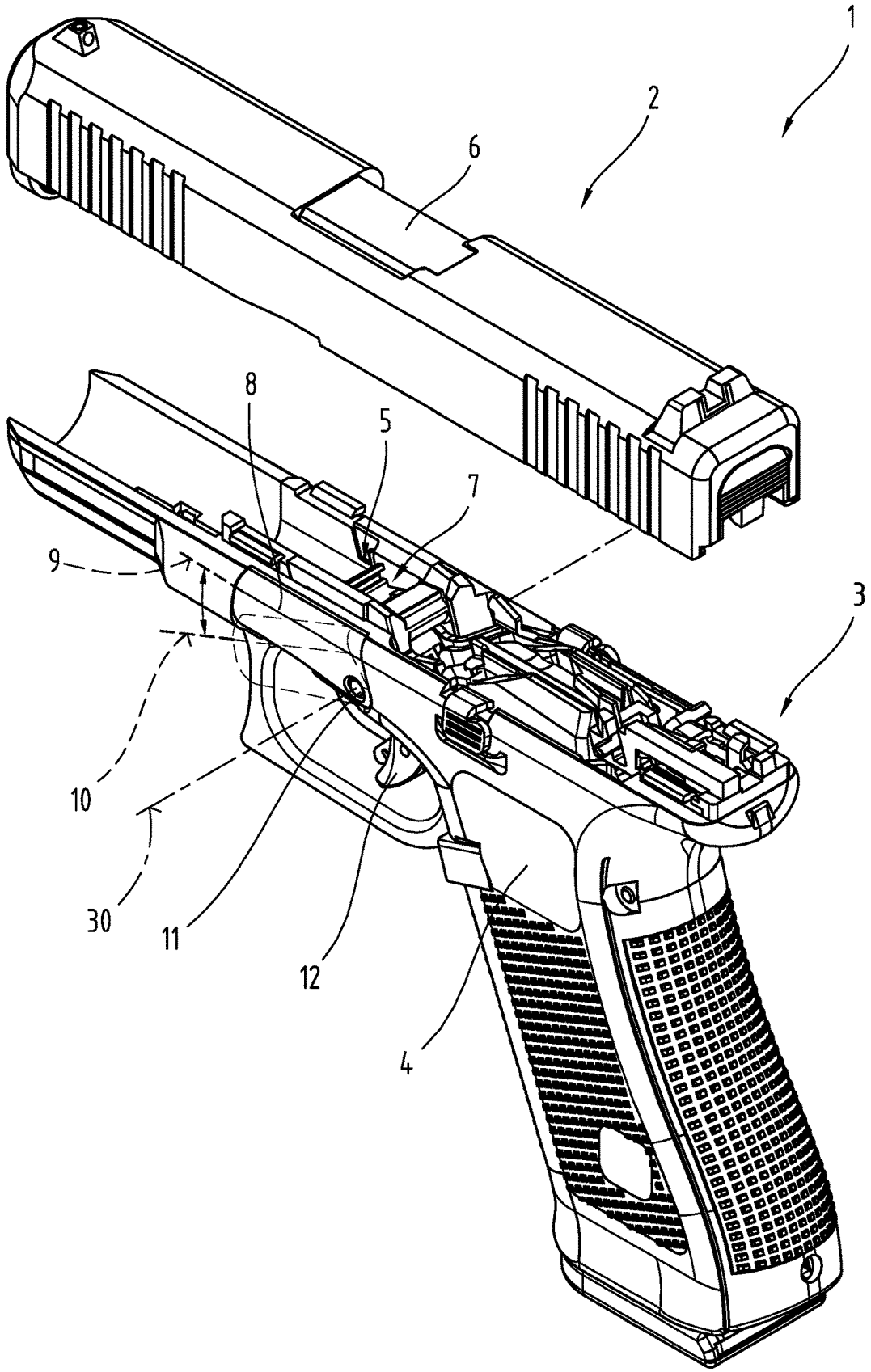
FIG. 1 an exploded illustration of a first embodiment of a firearm in a perspective view.

FIG. 1 shows an exploded illustration of a first embodiment of a firearm 1 in a perspective view.

As can be seen from FIG. 1, the firearm 1 can comprise a slide assembly 2. The firearm 1 can also comprise a receiver assembly 3. The slide assembly 2 and the receiver assembly 3 are shown spaced apart from one another in the illustration according to FIG. 1.

In particular, the slide assembly 2 is coupled to the receiver assembly 3 in the use state of the firearm 1.

The receiver assembly 3 can comprise a grip/receiver 4. Furthermore, the receiver assembly 3 can comprise a locking device 5. The locking device 5 can be used to catch or limit the movement of the slide assembly 2 relative to the receiver assembly 3. In particular, the locking device 5 can cooperate with a barrel 6 of the slide assembly 2.

In particular, a locking device receptacle 7 in which the locking device 5 can be received can be formed in the grip/receiver 4.

As can also be seen from FIG. 1, the locking device 5 can also comprise a locking lever 8.

In the illustration according to FIG. 1, the locking lever 8 is in a basic position 9. The locking lever 8 can be received on the grip/receiver 4 so as to be pivotable about a pivoting axis 30 in such a way that it can be pivoted manually and/or by the user of the firearm 1 into an open position 10.

In particular, the locking lever 8 can be pivotably attached to the grip/receiver 4 by means of a trigger axis 11. The trigger axis 11 can serve as a pivoting axis 30 in this case. A trigger 12 can also be pivotably attached to the grip/receiver 4 by means of the trigger axis 11. The locking lever 8 and the trigger 12 can thus be mounted so as to be pivotable about the same trigger axis 11.

Figure 2:
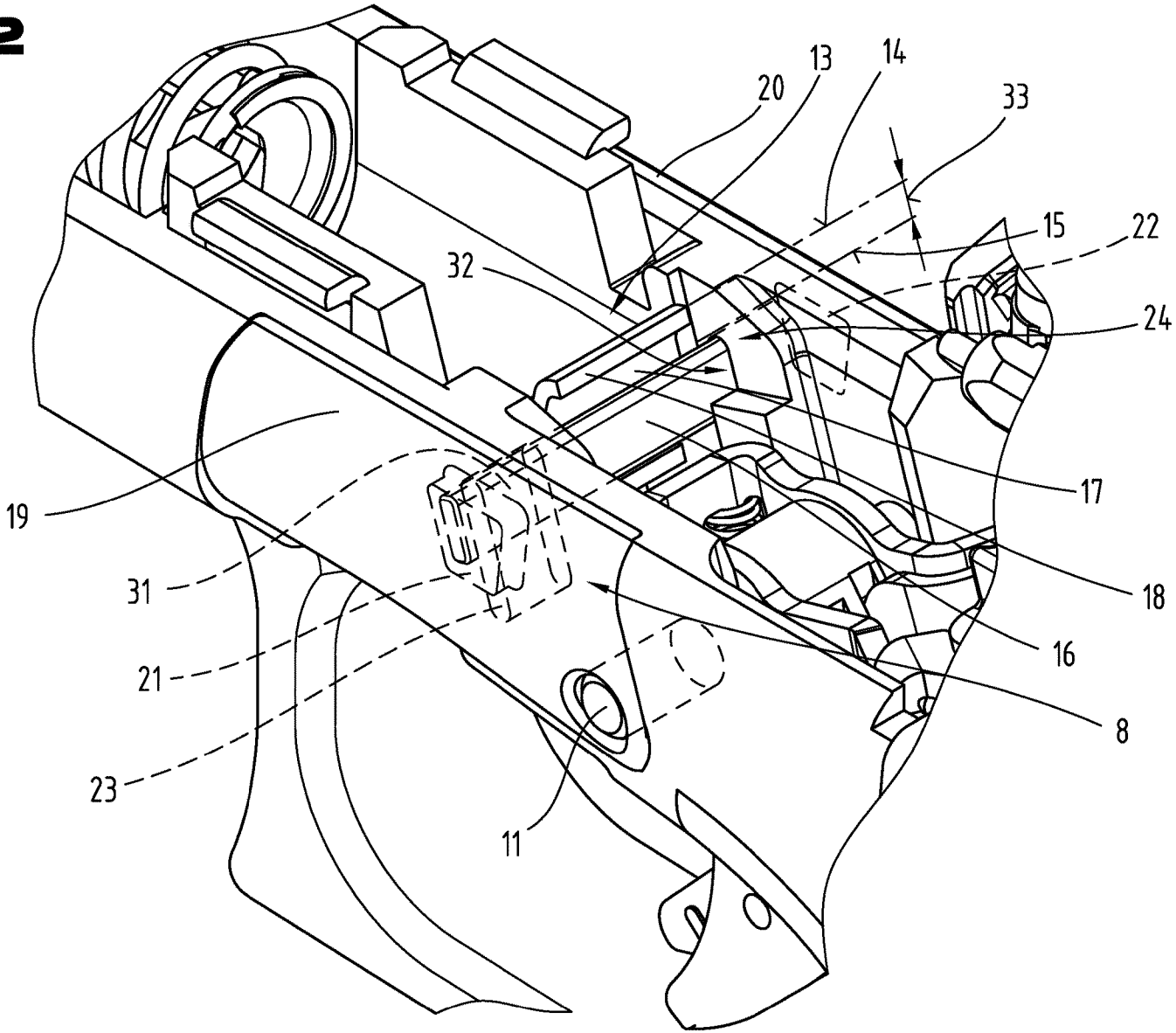
FIG. 2 detailed illustration of the first embodiment of the firearm in a perspective view.

FIG. 2 shows a perspective view of a first embodiment of the locking device 5; the same reference signs or component names as those in the previous FIG. 1 are used again here for the same parts. In order to avoid unnecessary repetition, reference is made to the detailed description in the preceding FIG. 1.

As can be seen from FIG. 2, a locking slider 13 can be provided which, by means of the locking lever 8, can move between a retaining position 14 and a release position 15.

In particular, the locking slider 13 can comprise an actuating part 16 and a retaining part 17. The actuating part 16 and the retaining part 17 can be designed as structurally independent components which can move relative to one another.

In particular, a retaining lug 18 can be formed on the retaining part 17, which retaining lug serves the function of interacting with a corresponding counter-element on the slide assembly 2, in particular on the barrel 6.

Furthermore, the actuating part 16 has an elongate extension and extends between a first lever part 19 and a second lever part 20 of the locking lever 8. The locking lever 8 can be designed as an injection-molded part, the first lever part 19 and the second lever part 20 of the locking lever 8 being couplable to one another as a single piece. Furthermore, it is also conceivable for the first lever part 19 and the second lever part 20 of the locking lever 8 to each be designed as structurally independent components which are coupled to one another.

In particular, a recess 21, 22, which serves to receive the actuating part 16, can be formed in each of the two lever parts 19, 20 of the locking lever 8. In this case, the first recess 21 can be arranged in the first lever part 19 of the locking lever 8, and the second recess 22 can be arranged in the second lever part 20 of the locking lever 8. In particular, a first guide member 31 of the locking slider 13, in particular of the actuating part 16, can be received in the first recess 21, and a second guide member 32 of the locking slider 13 can be received in the second recess 22.

Due to the actuating part 16 being received in the recess 21 in a form-fitting manner, a movement coupling between the locking lever 8 and the actuating part 16 can be achieved. In particular, the recess 21 can be designed such that, when the locking lever 8 is rotated between the basic position 9 and the open position 10, the actuating part 16 can be guided in the recesses 21, 22.

Furthermore, a first receiving slot 23 and a second receiving slot 24, in which the actuating part 16 is received so as to be linearly movable, can be formed in the grip/receiver 4. In particular, the first guide member 31 of the actuating part 16 can be received in the first receiving slot 23 and the second guide member 32 of the actuating part 16 can be received in the second receiving slot 24.

As can also be seen from FIG. 2, the retaining part 17 can have a smaller extension in a transverse direction of the firearm 1 than the actuating part 16. In other words, the first guide member 31 and the second guide member 32 of the actuating part 16 can protrude relative to the retaining part 17 in the transverse direction of the firearm 1.

In particular, the retaining part 17 can be received within the grip/receiver 4 between the two recesses 21, 22. Furthermore, the retaining part 17 can have a rounded shape, preferably toward the outside.

Figure 3:
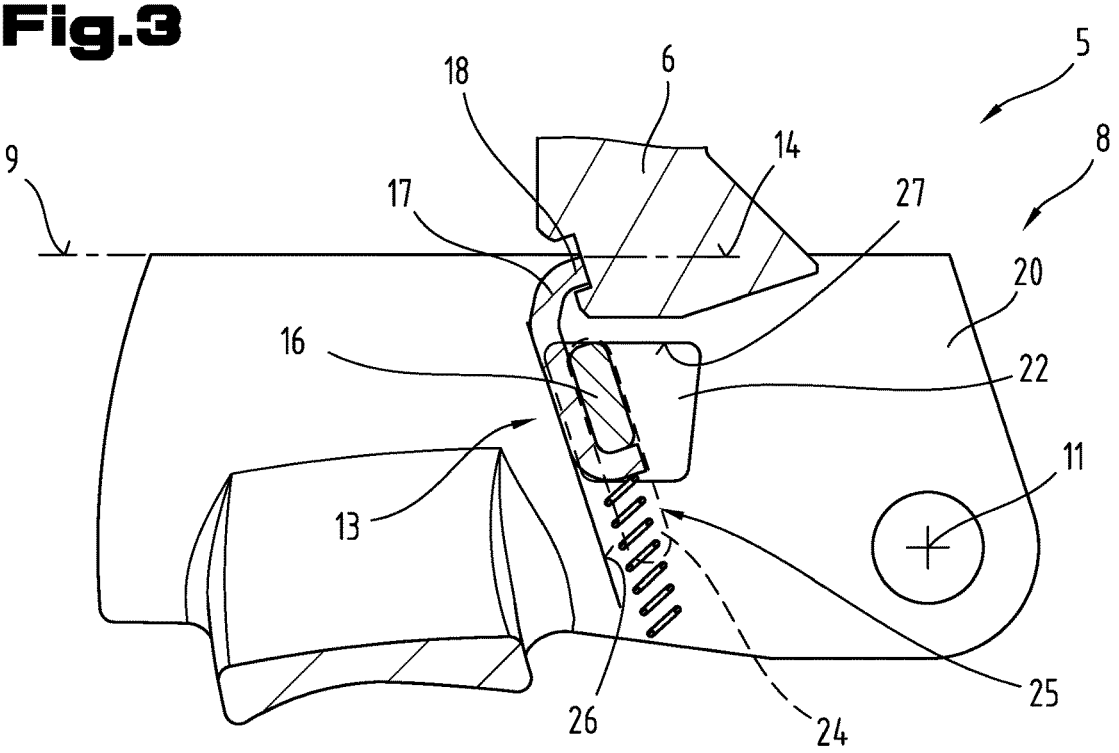
FIG. 3 a schematic illustration of a first embodiment of a locking device in a first position.
Figure 4:
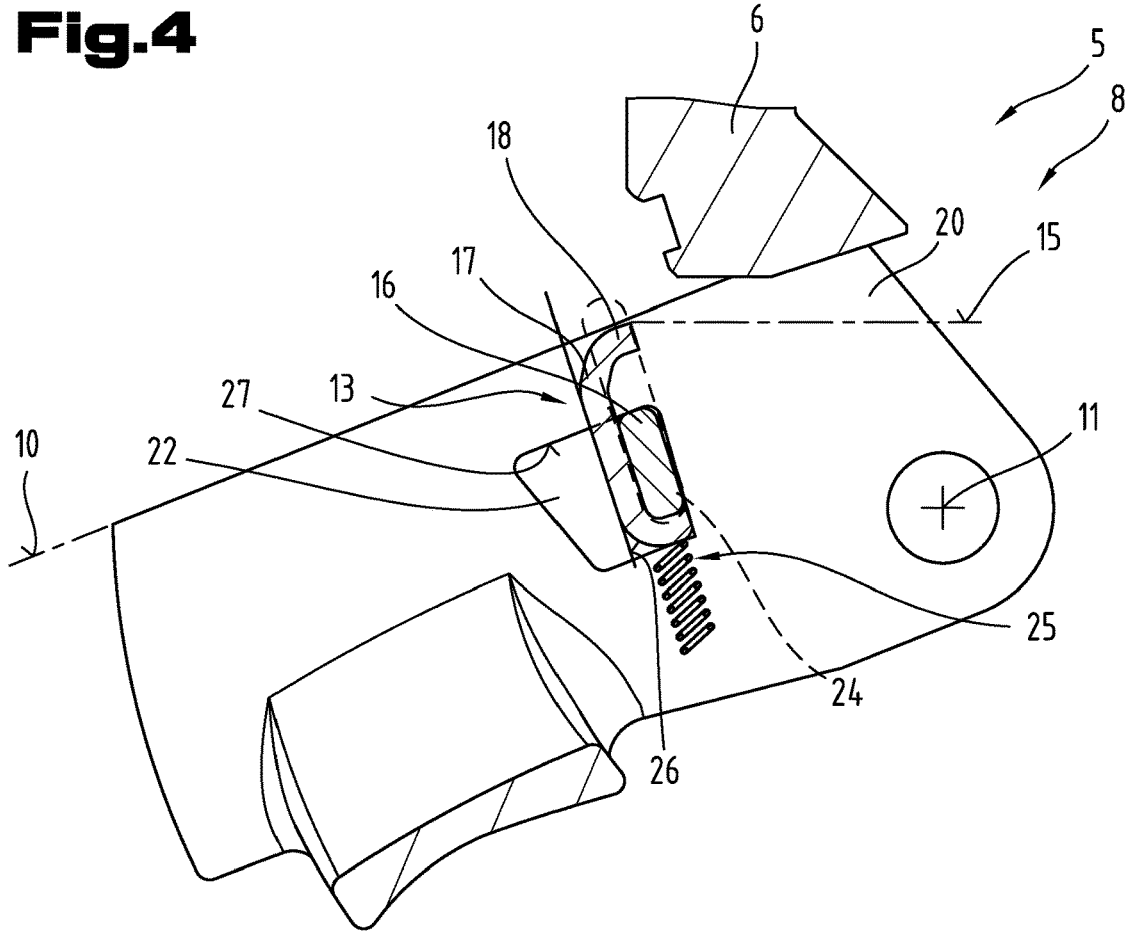
FIG. 4 a schematic illustration of the first embodiment of the locking device in a second position.
Figure 5:
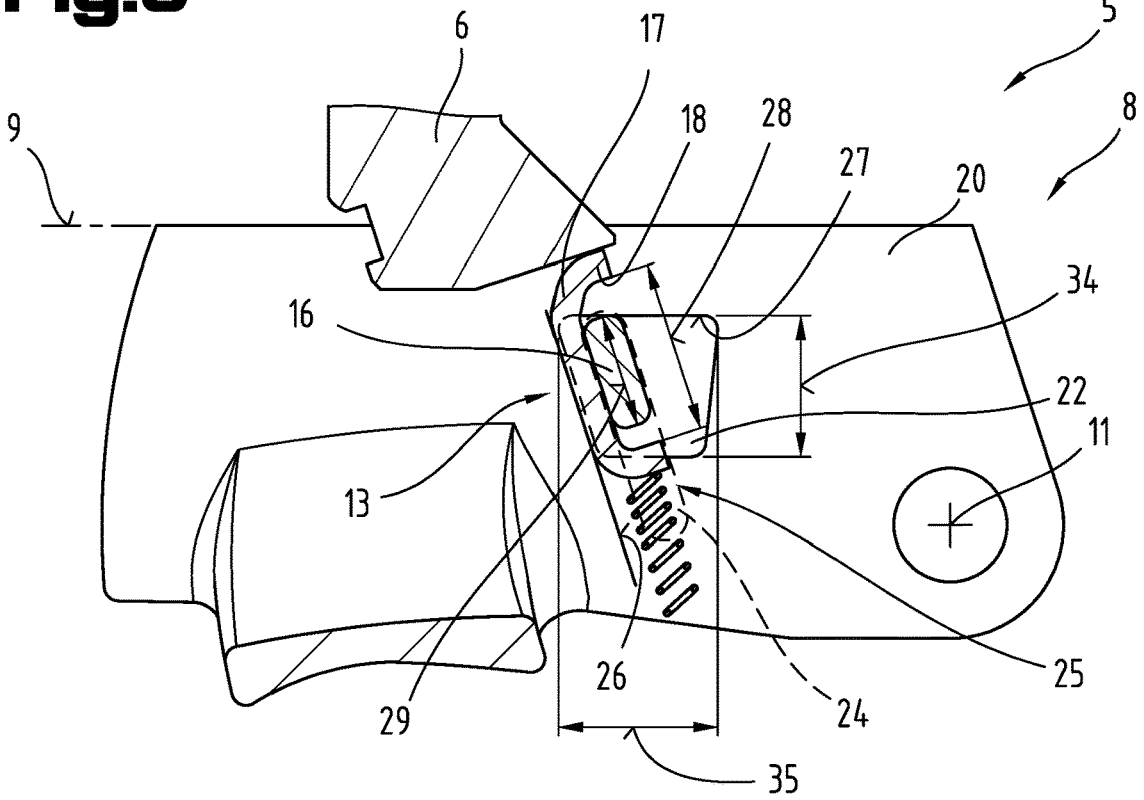
FIG. 5 a schematic illustration of the first embodiment of the locking device in a third position.

Various positions of the locking device 5 are shown schematically in FIGS. 3 to 5; the same reference signs or component names as those in the preceding FIGS. 1 and 2 are again used for the same parts. In order to avoid unnecessary repetition, reference is made to the detailed description in the preceding FIGS. 1 and 2.

The function of the locking device 5 is illustrated in FIGS. 3 to 5.

FIG. 3 shows a first position of the locking device 5. The locking lever 8 is located in its basic position 9 here. As this is a sectional view, only the second lever part 20 is visible.

The retaining part 17 of the locking slider 13 is in its retaining position 14. This is achieved by the retaining part 17 being forced into this retaining position 14 by means of a locking spring 25.

In particular, the retaining part 17 can be C-shaped, the actuating part 16 being receivable between the two legs of the C-shape. In the retaining position 14, the retaining part 17 can preferably rest against the actuating part 16, in particular against a lower leg of the C-shape, and thus held in position. Furthermore, the retaining part 17 can rest against a guide surface 26, it being possible for the guide surface 26 to be formed in the grip/receiver 4. The guide surface 26 is only indicated schematically.

As such, the retaining part 17 can be received in a form-fitting manner between the guide surface 26 of the grip/receiver 4 and the actuating part 16.

As can be clearly seen from FIG. 3, the actuating part 16 can be guided in the receiving slots 23, 24 in this case. Furthermore, the recesses 21, 22 each have a recess upper edge 27. The recess upper edge 27 of the recesses 21, 22 can be used to rest against the actuating part 16. Seen in cross section, the actuating part 16 can have a rounded shape in order to fit well into the C-shape of the retaining part 17. In addition, the rounded shape enables the actuating part 16 to rest properly against the recess upper edge 27 of the recesses 21, 22.

In the position shown in FIG. 3, the retaining part 17 is thus forced upward by means of the locking spring 25. As a result, the actuating part 16, which rests against the retaining part 17, is also forced upward. As a result, the locking lever 8, the recess upper edge 27 of which rests against the actuating part 16, is also forced upward.

The locking lever 8 moved by the user from its basic position 9 into the open position 10 in order to separate the slide assembly 2. The following steps are carried out in this case.

The locking lever 8 is rotated about the trigger axis 11, as a result of which the position of the recesses 21, 22 is moved downward. The actuating part 16, which rests against the recess upper edge 27, is also pushed downward in this case by being linearly guided in the receiving slots 23, 24. The retaining part 17, which surrounds the actuating part 16 in a form-fitting manner and rests against it, is also pushed downward in this case. As a result, the retaining part 17 is guided from its retaining position 14 into its release position 15. The retaining part 17, in particular the retaining lug 18, is now therefore no longer in engagement with the corresponding counter-part of the barrel 6, as a result of which the slide assembly 2 can be removed from the receiver assembly 3.

When performing the steps described above, the locking spring 25, which was already previously pretensioned, will be compressed further.

If the locking lever 8 is then let go or released by the user, the force of the locking spring 25 can return the whole system to its original position, as is shown and described in FIG. 3. In an alternative embodiment, it is also conceivable for the locking lever 8, in its open position 10, to lock or snap into place, and only return to its basic position 9 following an impulse, for example an initial backward thrust.

FIG. 5 shows a further method step for assembling the slide assembly 2 with the receiver assembly 3. As can be seen from FIG. 5, it is not absolutely necessary during the assembly of the slide assembly 2 with the receiver assembly 3 for the locking lever 8 to be moved out of its basic position 9.

This can be achieved by the barrel 6, during the assembly, moving the retaining part 17 downward counter to the spring force of the locking spring 25. A corresponding bevel can be formed on the barrel 6 in this case. Furthermore, a bevel and/or the C-shape of the retaining part 17 correspond to the bevel on the barrel, so that the slide assembly 2 being pushed onto the receiver assembly 3 results in the retaining part 17 moving out of its retaining position 14 counter to the spring force of the locking spring 25.

Due to the structurally independent design of the retaining part 17 and the actuating part 16, the retaining part can 17 be moved downward without the actuating part 16, and thus locking lever 8, being moved in the process. In particular, this can be achieved by the C-shaped form of the retaining part 17, and by embedding the actuating part 16 therein.

In particular, the retaining part 17 can have an open portion extension 28. Furthermore, the actuating part 16 can have a height 29. In particular, the height 29 of the actuating part 16 can be smaller than the open portion extension 28 of the retaining part 17.

The retaining position 14 and the release position 15 are arranged at a release distance 33 from one other, as can also be seen in FIG. 2.

In particular, the height 29 of the actuating part 16 can be smaller, at least by the release distance 33 between the retaining position 14 and the release position 15, than the open portion extension 28 of the retaining part 17.

If, at this point during the joining process, the slide assembly 2, in particular the barrel 6, is pushed far enough onto the receiver assembly 3 and is at least in a position as shown in FIG. 3, the retaining part 17 can be moved or forced back into its retaining position 14 by the spring force of the locking spring 25. This allows the slide assembly 2 to be secured to the receiver assembly 3.

Figure 6:
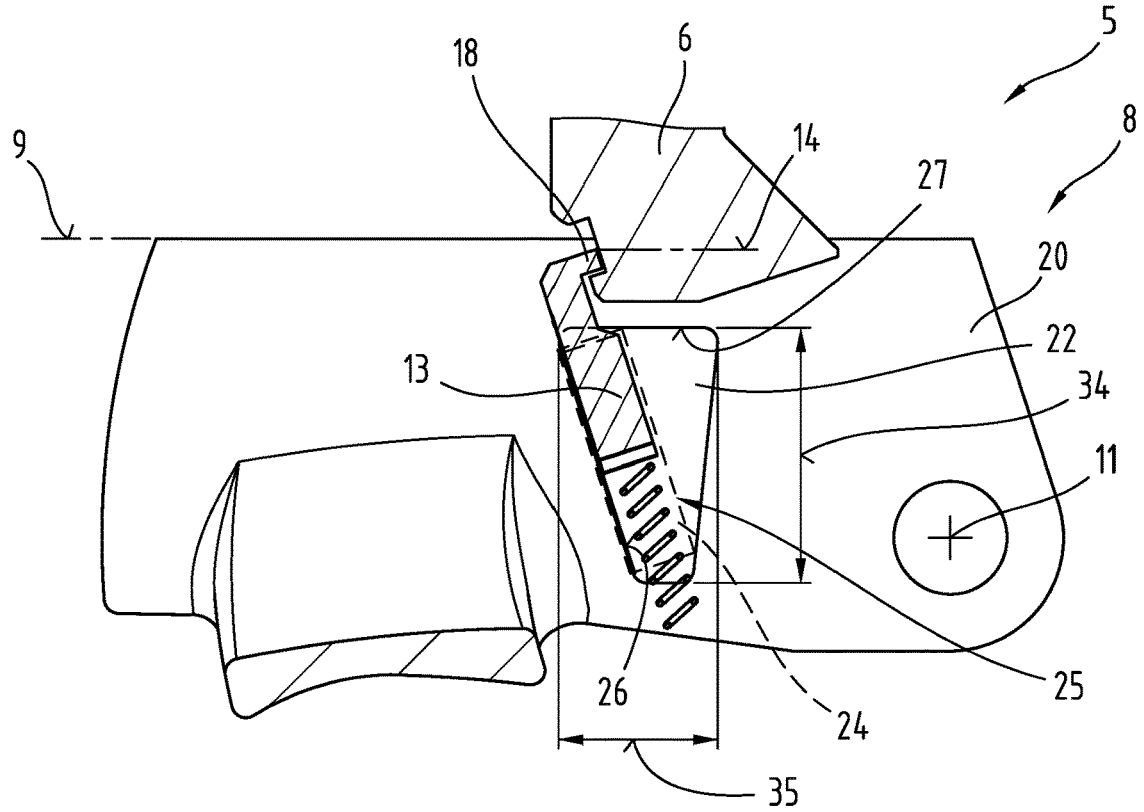
FIG. 6 a schematic illustration of a second embodiment of the locking device in a first position.

FIG. 6 shows an alternative embodiment of the locking device 5; the same reference signs or component names as those in the preceding FIGS. 1 to 5 are used for the same parts. In order to avoid unnecessary repetition, reference is made to the detailed description in the preceding FIGS. 1 to 5.

As can be seen from FIG. 6, the locking slider 13 can be formed as a single piece. The retaining lug 18 can thus be formed directly on the part which has the first guide member 31 and the second guide member 32 that are guided in the recesses 21, 22. In particular, in this case, it is possible for the retaining lug 18 not to extend across the entire width of the locking slider 13, and for the retaining lug 18 to be formed only in a central region instead, so that corresponding receiving of the locking slider 13 in the receiving slots 23, 24 is made possible.

Actuation of the locking slider 13 or transfer of the locking slider 13 from its retaining position 14 into the release position 15 of the embodiment described in FIG. 6 takes place, mutatis mutandis, as in the description of FIG. 4, by rotating the locking lever 8.

In the embodiment of the locking device 5 according to FIG. 6, the slide assembly 2 is joined to the receiver assembly 3 as follows.

Due to corresponding inclined surfaces on the barrel 6, the locking slider 13 is pushed downward out of its retaining position 14. In this case, the recesses 21, 22 in the locking lever 8 have a height that is sufficient for the locking slider 13 to glide downward without the locking lever 8 moving out of its basic position 9 in the process.

In particular, the height 29 of the actuating part 16 is smaller than the height of the recesses 21, 22 at least by a distance between the retaining position 14 and the release position 15.

In particular, the recesses 21, 22 have a recess height 34 and a recess width 35.

Figure 7:
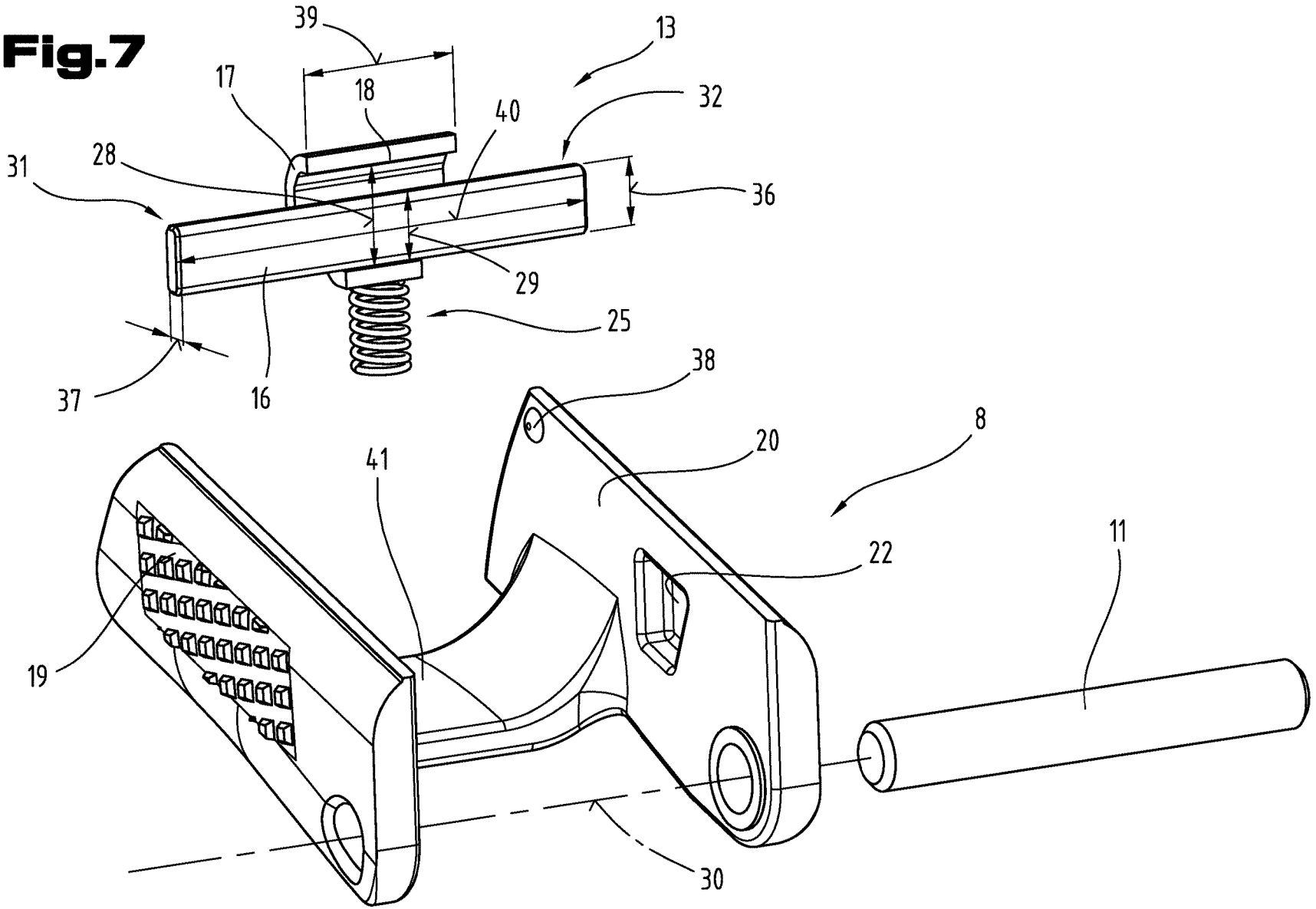
FIG. 7 an exploded perspective illustration of the first embodiment of the locking device.

FIG. 7 shows a perspective exploded illustration of a first embodiment of the locking device 5; the same reference signs or component names as in the previous FIGS. 1 to 5 are used again here for the same parts. In order to avoid unnecessary repetition, reference is made to the detailed description in the preceding FIGS. 1 to 5.

As can be seen from FIG. 7, the guide member 31 has a guide member height 36 and a guide member width 37.

Furthermore, the locking lever 8 can have rest protrusions 38 or rest elements, so that it remains in its basic position 9 during the joining process, as shown in FIG. 5. These rest elements can be triggered with an actuating force that is so low that it does not disturb the rotation of the locking lever 8 by the user.

From FIG. 7 it can also be seen that the retaining part 17 has a retaining part width 39. The actuating part 16 has an actuating part width 40. In particular, the retaining part width 39 is smaller than the actuating part width 40, so that the first guide member 31 and the second guide member 32 protrude relative to the retaining part 17 in width.

Furthermore, it can be clearly seen in FIG. 7 that the first lever part 19 and the second lever part 20 of the locking lever 8 can be coupled to each other via a connecting member 41. In particular, the locking lever 8 can be U-shaped, with the connecting member 41 forming the base and the first lever part 19 and the second lever part 20 forming the two legs. The locking lever 8 can surround the grip/receiver 4 in a U-shape.

Figure 8:
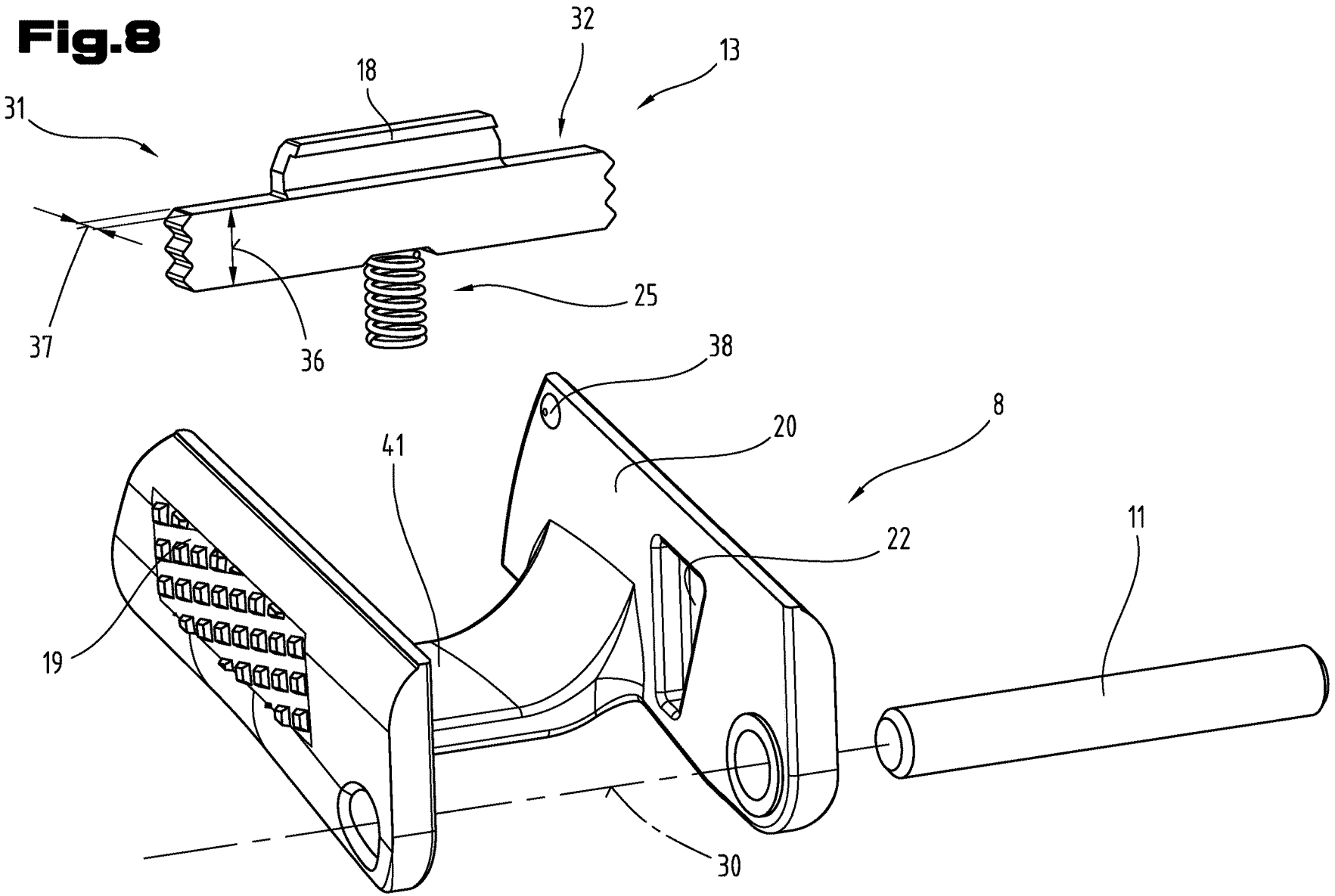
FIG. 8 an exploded perspective illustration of the second embodiment of the locking device.

FIG. 8 shows a perspective exploded illustration of the second embodiment of the locking device 5; the same reference signs or component names as in the previous FIG. 6 are used again here for the same parts. In order to avoid unnecessary repetition, reference is made to the detailed description in the preceding FIG. 6.

As can be seen from FIG. 8, the locking slider 13 can be formed in one piece, with the retaining lug 18, the first guide member 31, and the second guide member 32 being formed on the one-piece locking slider 13.

The position information chosen in the description, such as upward, downward, to the side, etc., relate to the position of the 1 shown in FIG. 1. The front in this case is on the left side of FIG. 1, and thus at the muzzle of the barrel 6. A longitudinal direction extends parallel to the barrel 6. A width or transverse direction extends in the width of the firearm transversely to the longitudinal direction.

The embodiments show possible embodiments. It should be noted here that the invention is not limited to the specific embodiments shown; rather, various combinations of the individual embodiments are possible, and, based on the technical teaching through the present invention, this possibility of variation is within the ability of a person skilled in the art working in this technical field.

The scope of protection is determined by the claims. However, the description and the drawings should be used to interpret the claims. Individual features or combinations of features from the different embodiments shown and described can represent independent inventive solutions. The problem addressed by the independent inventive solutions can be found in the description.

All information on value ranges in the present description should be understood to include any and all sub-ranges thereof, e.g. 1 to 10 should be understood to include all sub-ranges from the lower limit 1 to the upper limit 10, i.e. all sub-ranges begin with a lower limit of 1 or more and end at an upper limit of 10 or less, for example 1 to 1.7, or 3.2 to 8.1, or 5.5 to 10.

Finally, it should be noted that, for a better understanding of the structure, some elements have been shown not to scale and/or enlarged and/or made smaller.

The invention claimed is:

1. A locking device for installation in a receiver assembly of a firearm, wherein the locking device serves for limiting a movement of a slide assembly relative to the receiver assembly, and wherein unlocking of the locking device allows removal of the slide assembly from the receiver assembly, the locking device comprising:

a locking slider comprising a retaining lug, the retaining lug configured to interact with a barrel received in the slide assembly of the firearm in a retaining position to limit a movement of the slide assembly relative to the receiver assembly;

a first guide member formed on the locking slider and configured to be received in a first receiving slot of a grip/receiver of the receiver assembly a second guide member formed on the locking slider and configured to be received in a second receiving slot of the grip/receiver of the receiver assembly; and a locking lever movable between the retaining position and the release position via the locking lever, the locking lever being receivable on the grip/receiver of the receiver assembly so as to be pivotable about a pivoting axis between a basic position and an open position, wherein the locking slider is couplable to the locking lever in such a way that the locking lever serves to actuate the locking slider, and wherein a transfer of the locking slider from the retaining position to the release position is effected by rotation of the locking lever.

2. The locking device of claim 1 wherein the locking slider further comprises:

an actuating part, wherein the first guide member and the second guide member are formed on the actuating part of the locking slider; and a retaining part arranged on the retaining lug, wherein the actuating part and the retaining part are configured to be structurally independent components, and wherein the retaining part can be moved downwards without the actuating part and the locking lever connected thereto being moved.

3. The locking device of claim 2 wherein the retaining part is C-shaped having two legs, and wherein the actuating part is receivable between the two legs of the C-shaped retaining part.

4. The locking device of claim 2 wherein the actuating part has a greater width than the retaining part such that the first guide member and the second guide member protrude relative to the actuating part.

5. The locking device of claim 2 wherein the actuating part and the retaining part are shaped sheet metal parts.

6. The locking device of claim 2 wherein a height of the actuating part is smaller than an open portion extension of the retaining part.

7. A receiver assembly for a firearm, the receiver assembly comprising:

a grip/receiver;

a locking device configured to i) limit a movement of a slide assembly relative to the receiver assembly, ii) allow removal of the slide assembly from the receiver assembly when the locking device is unlocked, and iii) be received in a locking device receptacle of the grip/receiver, the locking device comprises:

a locking slider having a retaining lug configured to interact with a barrel that is received in the slide assembly of the firearm, wherein the retaining lug is configured to i) limit a movement of the slide assembly relative to the receiver assembly when the retaining lug is in a retaining position and ii) release the slide assembly when the retaining lug is in a release position;

a first guide member formed on the locking slider, the first guide member is configured to be received in a first receiving slot of the grip/receiver;

a second guide member formed on the locking slider, the second guide member is configured to be received in a second receiving slot of the grip/receiver; and a locking lever couplable to the locking slider, the locking lever configured to move the locking slider between the retaining position and the release position, wherein the locking lever is configured to be received on the grip/receiver of the receiver assembly such that the locking lever is pivotable about a pivoting axis between a basic position and an open position, and wherein the locking slider is couplable to the locking lever in such a way that the locking lever serves to move the locking slider from the retaining position into the release position, and wherein a transfer of the locking slider from its retaining position to the release position is effected by rotation of the locking lever.

8. The receiver assembly of claim 7 wherein the locking lever further comprises:

a first lever part having a first recess formed therein, wherein the first guide member is further configured to be received in the first recess in a form-fitting manner; and a second lever part having a second recess formed therein, and wherein the second guide member is further configured to be received in the second recess in a form-fitting manner.

9. The receiver assembly of claim 8 wherein the first guide member has a guide member height and the first recess has a recess height, and wherein a release distance is formed between the retaining position and the release position, and wherein the recess height is at least as great as a sum of the guide member height plus the release distance.

10. The receiver assembly of claim 7 wherein the locking slider is configured as one piece, and wherein the retaining lug, the first guide member, and the second guide member are formed on one component.

11. The receiver assembly of claim 7 wherein the grip/receiver is configured to receive a trigger that is pivotable about a trigger axis, and wherein the trigger axis is coaxial with the pivoting axis.

12. The receiver assembly of claim 8 wherein the first recess has a first recess width and the first guide member has a first guide member width, and wherein the first recess width is between 105% and 700% of the first guide member width.

13. The receiver assembly of claim 7 wherein the locking device is configured such that the retaining lug of the locking slider can move from the retaining position to the release position counter to a spring force of a locking spring without the locking lever having to be pivoted from the basic position to the open position.

14. A firearm comprising:

a slide assembly; and a receiver assembly that receives the slide assembly, the receiver assembly comprising:

a locking device configured to i) limit a movement of a slide assembly relative to the receiver assembly, ii) allow removal of the slide assembly from the receiver assembly when the locking device is unlocked, and iii) be received in a locking device receptacle of the grip/receiver, the locking device comprises:

a locking slider having a retaining lug configured to interact with a barrel that is received in the slide assembly of the firearm, wherein the retaining lug is configured to i) limit a movement of the slide assembly relative to the receiver assembly when the retaining lug is in a retaining position and ii) release the slide assembly when the retaining lug is in a release position;

a first guide member formed on the locking slider, the first guide member is configured to be received in a first receiving slot of the grip/receiver;

a second guide member formed on the locking slider, the second guide member is configured to be received in a second receiving slot of the grip/receiver; and a locking lever coupled to the locking slider, the locking lever configured to move the locking slider between the retaining position and the release position, wherein the locking lever is configured to be received on the grip/receiver of the receiver assembly such that the locking lever is pivotable about a pivoting axis between a basic position and an open position, and wherein the locking lever is coupled to the locking slider in such a way that the locking lever serves to move the locking slider from the retaining position into the release position, and wherein a transfer of the locking slider from the retaining position to the release position is effected by rotation of the locking lever.

15. The firearm of claim 14 wherein the locking lever comprises:

a first lever part having a first recess formed therein, wherein the first guide member is further configured to be received in the first recess in a form-fitting manner; and a second lever part having a second recess formed therein, wherein the second guide member is further configured to be received in the second recess in a form-fitting manner.

16. The firearm of claim 15 wherein the first guide member has a guide member height and the first recess has a recess height, and wherein a release distance is formed between the retaining position and the release position, and wherein the recess height is at least as great as a sum of the guide member height plus the release distance.

17. The firearm of claim 14 wherein the locking slider is configured as one piece, and wherein the retaining lug, the first guide member, and the second guide member are formed on one component.

18. The firearm of claim 14 wherein the grip/receiver is configured to receive a trigger that is pivotable about a trigger axis, and wherein the trigger axis is coaxial with the pivoting axis.

19. The firearm of claim 15 wherein the first recess has a first recess width and the first guide member has a first guide member width, and wherein the first recess width is between 105% and 700% of the first guide member width.

20. The firearm of claim 15 wherein the locking device is configured such that the retaining lug of the locking slider can move from the retaining position to the release position counter to a spring force of a locking spring without the locking lever having to be pivoted from the basic position to the open position.

* * * * *